US005823493A

United States Patent [19]

Eastland, Jr. et al.

[11] Patent Number: 5,823,493

[45] Date of Patent: Oct. 20, 1998

[54] STRAW HOLDER

[76] Inventors: James J. Eastland, Jr., P.O. Box 314, Ivoryton, Conn. 06442; H. Kirk Watson, 42 The Ridge, Glastonbury, Conn. 06033

[21] Appl. No.: 734,622

[22] Filed: Oct. 18, 1996

[51] Int. Cl.[6] ..... A47B 96/06

[52] U.S. Cl. ..... 248/213.2; D7/300.2; 248/79

[58] Field of Search ..... 248/313, 213.2, 248/79; D7/300.2, 601, 635

[56] References Cited

U.S. PATENT DOCUMENTS

| | | | |
|---|---|---|---|
| 344,567 | 6/1886 | Coleman . | |
| 1,627,734 | 5/1927 | Gavaza | 248/79 |
| 1,735,144 | 11/1929 | Tanner . | |
| 1,746,151 | 2/1930 | Goldman | 248/79 |
| 2,070,495 | 2/1937 | Strutz et al. . | |
| 2,378,660 | 6/1945 | Roux . | |
| 2,460,542 | 2/1949 | Smith . | |
| 2,469,292 | 5/1949 | Cornwell . | |
| 2,636,240 | 4/1953 | Pokorny | 248/213.2 |
| 3,488,769 | 1/1970 | Falkenberg | D7/300.2 |
| 3,648,334 | 3/1972 | Swalm | 248/79 |
| 4,196,747 | 4/1980 | Quigley et al. | 137/527.8 |
| 4,551,329 | 11/1985 | Harris et al. | D7/300.2 |
| 4,699,318 | 10/1987 | Donatello et al. | 239/33 |
| 4,775,060 | 10/1988 | Pinney | 215/100 |
| 4,850,495 | 7/1989 | Wallace | 215/101 |
| 5,046,628 | 9/1991 | Florjancic | 215/100 R |
| 5,671,863 | 9/1997 | Uliana | 248/79 |

*Primary Examiner*—Leslie A. Braun
*Assistant Examiner*—Kimberly T. Wood
*Attorney, Agent, or Firm*—Alix, Yale & Ristas, LLP

[57] ABSTRACT

A straw holder formed from a unitary strip having a center body and first and second wing members that extend laterally from the body. The wing members include a distal tip portion that are flexed towards each other and a slot in each tip portion receives an engagement segment of the other tip portion to lock the tip portions together and form the straw holder. A straw is inserted through an opening in the body into the container and the wing members engage the exterior surface of the beverage container to mount the straw to the container. One laterally extending edge defines a shoulder which engages the rim of the container to position the straw holder and straw. The material and thickness of the strip are selected such that the strip is semi-flexible, wherein the strip may be easily flexed while resiliently resisting such flexure. Such semi-flexible property causes the strip to bow laterally outward between the tip portions and the body. The bowed structure causes the shoulders to be laterally offset from each other and ensures that the body resists closure of the opening, thereby providing greater stability in positioning the straw and straw holder on the container and preventing crimping of the straw.

12 Claims, 4 Drawing Sheets

STRAW HOLDER

BACKGROUND OF THE INVENTION

This invention relates generally to support devices for elongated tubular articles. More particularly, the present invention relates to support devices for supporting a drinking straw in conjunction with a beverage container such as a cup or a glass.

Drinking straws are commonly used to facilitate drinking from a glass, cup or similar beverage container. Generally, both the beverage container and the drinking straw must be individually grasped to allow proper use and to prevent spillage of the beverage or possible injury to the user. Invalids and children often have difficulty grasping both the container and the straw, often requiring both hands to safely grasp the container.

Movement of the contents of the beverage container due to melting of ice and the like often causes movement of the straw within the container. If such movement is not noticed or occurs as the container is lifted for drinking, the portion of the straw which extends outside of the container may strike the user in the face or the eye. In addition, the carbon dioxide in carbonated beverages often comes out of solution and adheres to the surface of the straw. When a sufficient quantity of carbon dioxide has accumulated on the straw, the straw becomes positively buoyant forcing a longer portion of the straw out of the container. Such straws may be accidently struck by a hand or arm, causing spillage and possible tipping of the container.

Various straw holder apparatus have been developed for use in conjunction with a glass, a tumbler or similar container. The majority of such straw holders employ apparatus having a first portion which is used to mount the holder to the container and a second portion which holds the straw. For example, U.S. Pat. Nos. 344,567, 2,070,495, 2,378,660, 4,196,747 and 4,850,495 disclose straw holders having a straw retention member which is attached to first and second vertically disposed container grasping members. U.S. Pat. Nos. 1,735,144 and 2,469,292 disclose straw holders having a circular coil spring for receiving the container which is attached to a vertically extending straw retention member.

Such straw holders utilize a spring force to grasp the container between opposed grasping members or within a circular spring. The spring force exerted by the grasping members and circular springs may damage the container, causing failure of the container or a risk of personal injury. Circular springs may crush the container where such containers are composed of paper or plastic. Grasping members may chip or fracture the rim of containers made of brittle material such as glass. In addition, such straw holders may be limited in use. Circular springs will not grasp a container having an outside diameter which is smaller than the inside diameter of the coil. Grasping members will not receive containers having a wall thickness which is greater than the maximum distance between the members.

U.S. Pat. No. 4,775,060 discloses a decorative straw holder in the shape of an animal wherein the rear feet of the animal body engage the outside surface of the container, the front feet engage the rim and inside surface of the container and the straw is inserted through a passage in the head of the animal body. Such decorative straw holders are expensive to manufacture and may not be used on containers having a radius of curvature which is different than that allowed by the front feet of the animal body.

U.S. Pat. No. 2,460,542 discloses a straw holder which clamps the container between the straw and a pair of legs. The holder is positioned on the rim of the container wherein the legs engage the outside surface of the container and the lower half loop is disposed above the container interior. The straw is forced through the upper and lower half loops and along the inside surface of the container, drawing the upper half loop inwardly and clamping the straw to the container. Common drinking straws manufactured from wood pulp or thin plastic do not have sufficient mechanical integrity to force passage between the upper and lower half loops and to clamp the container wall. Such straws bend and/or collapse when used in this manner.

SUMMARY OF THE INVENTION

Briefly stated, the invention in a preferred form is a straw holder which comprises a unitary strip having a center body and first and second wing members that extend laterally from the body. Each wing member comprises a tip portion, wherein the tip portions are flexed towards each other and mounted to each other to form a three-dimensional straw holder. The wing members engage the exterior surface of the beverage container and a straw is received in an opening in the body to mount the straw to the container. Such strips may be easily and inexpensively manufactured.

The strip further comprises first and second laterally extending edges. The first edge has a compound arcuate shape wherein a portion of the edge defines a shoulder which engages the rim of the container for positioning the straw holder and straw. The second edge has a substantially arcuate shape which minimizes the extent to which the straw holder extends beyond the beverage container.

Each wing member comprises a distal tip portion which defines a slot and an engagement segment. The slot of the first tip portion extends from the first edge, the slot of the second tip portion extends from the second edge, and the corresponding engagement segment extends between the slot and the opposite edge. The strip is formed into a three dimensional straw holder by flexing the first and second wing members towards each other and inserting the engagement segment of the first tip portion into the slot of the second tip portion and inserting the engagement segment of the second tip portion into the slot of the first tip portion.

The strip is semi-flexible, wherein the strip may be easily flexed while resiliently resisting such flexure. The flexibility of the strip allowing the strip to be easily formed into the three dimensional straw holder while the resistance to flexure causes the strip to bow laterally outward between the tip portions and the body. Such bowed structure ensures that the shoulder formed on the first wing member is laterally offset from the shoulder formed on the second wing member, providing greater stability when the straw and straw holder are positioned on the container. The bowed structure also ensures that the body resists closure of the opening when the strip is formed into a straw holder, preventing crimping of the straw. The semi-flexible property of the strip is determined by selection of the strip material and thickness.

It is an object of the invention to provide a new and improved straw holder that may be easily and inexpensively manufactured.

It is another object of the invention to provide a new and improved straw holder that does not utilize a spring force to mount the straw holder to the container It is a further object of the invention to provide a new and improved straw holder that does not crimp the straw.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1A:
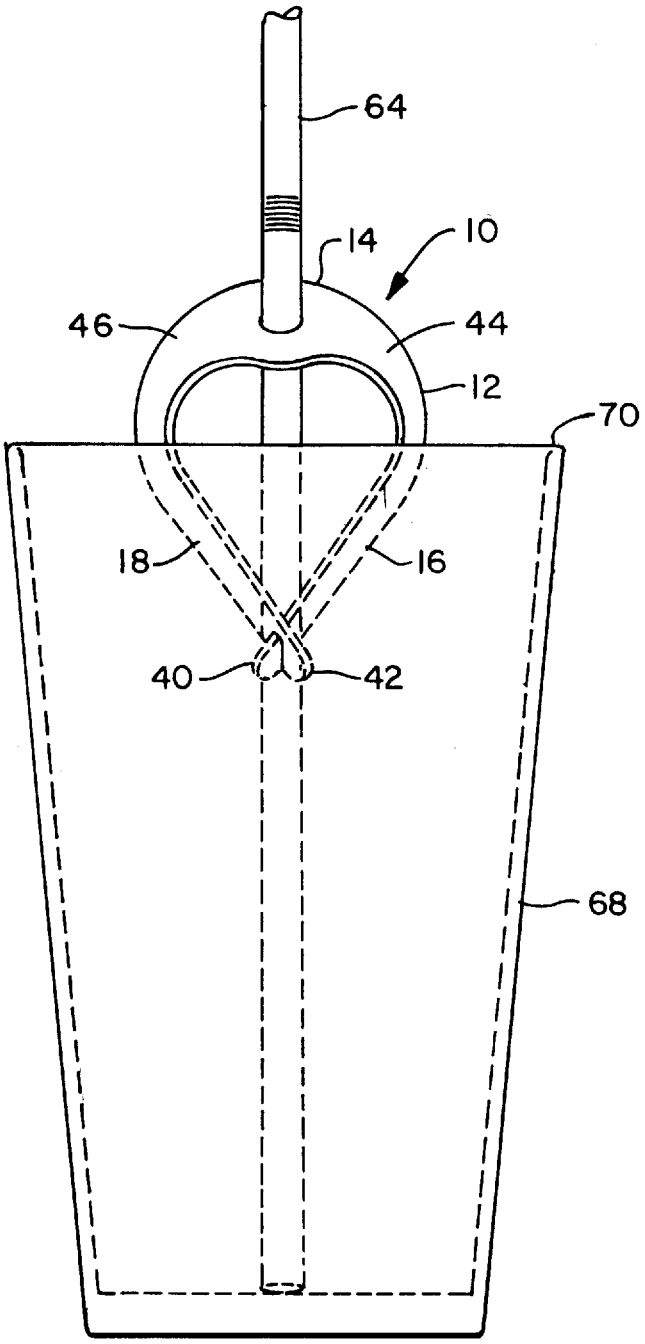
FIG. 1*a* is a front elevation view, partly in phantom, of a straw mounted to a beverage container by a straw holder in accordance with the invention.

With reference to the drawings wherein like numerals represent like parts throughout the several figures, a straw holder in accordance with the present invention is generally designated by the numeral 10. The straw holder 10 is initially formed as a flat unitary strip 12 having a center body 14, first and second wing members 16, 18 that extend laterally from the body 14, and first and second laterally extending edges 20, 22. Preferably, the strip 12 is stamped from a sheet or coil of polymeric material.

Figure 2:
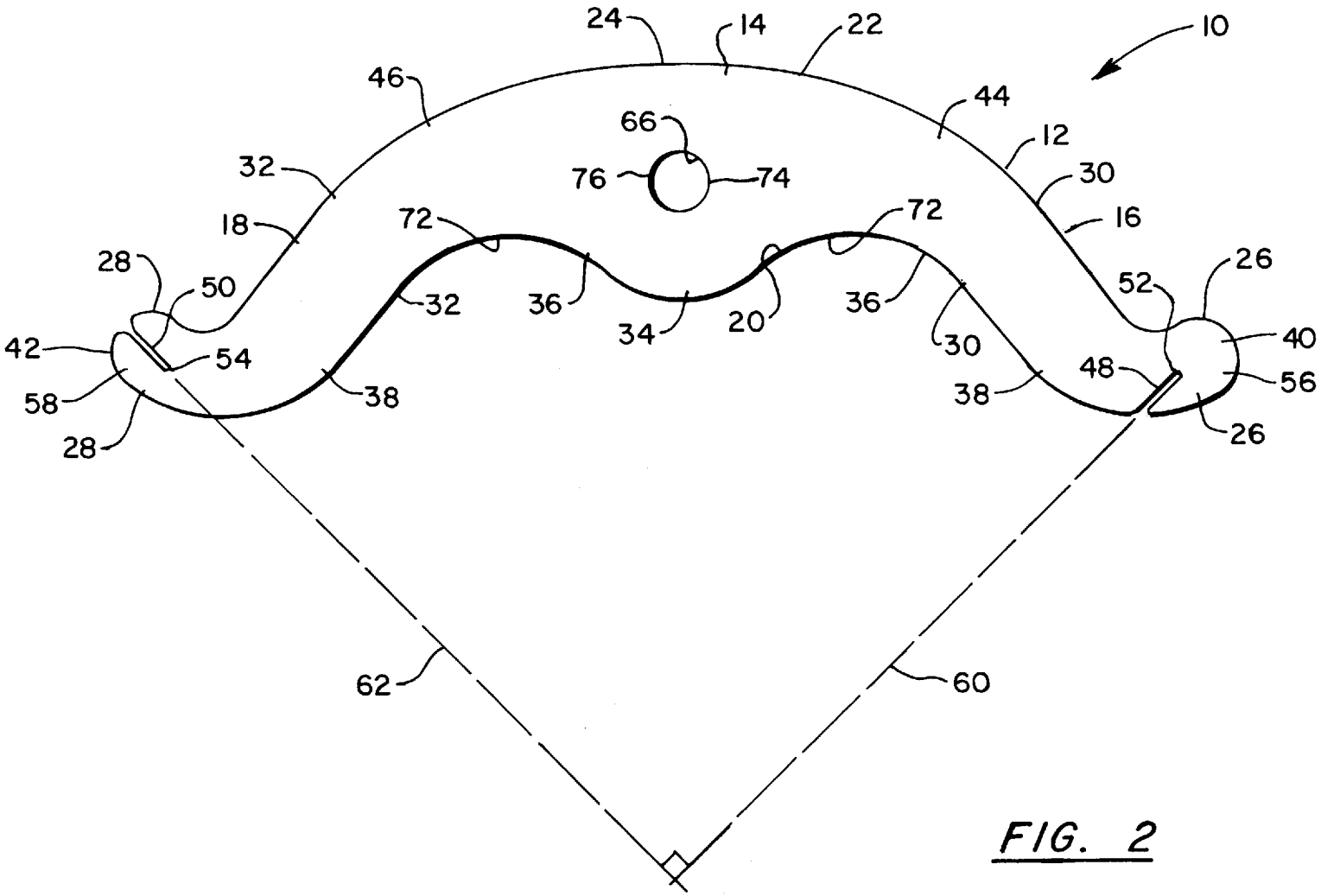
FIG. 2 is an enlarged top plan view of the first straw holder of FIG. 1, showing the first wing member dismounted from the second wing member.

With reference to FIG. 2, the first and second edges 20, 22 of the strip 12 each comprise a body segment 24, first and second tip segments 26, 28 and first and second extension segments 30, 32 connecting the tip segments 26, 28 and the body segment 24. The body segment 24 of the first edge 20 has a mid portion 34 and each extension segment 30, 32 of the first edge 20 has a proximal portion 36 adjacent the body segment 24 and a distal portion 38 adjacent the tip segment 26, 28. Preferably, the body segment 24 and the extension segments 30, 32 of the second edge 22 define a substantially arcuate surface. The two tip segments 26, 28 of the second edge 22 extend outwardly from the extension segments 30, 32 of the second edge 22, preferably at an angle of about ninety (90) degrees. The first edge 20 has a compound arcuate shape wherein the mid portion 34 of the body segment 24 curves outward away from the second edge 22, the proximal portion 36 of each extension segment 30, 32 curves inward towards the second edge 22, and the distal portion 38 of each extension segment 30, 32 and each tip segment 26, 28 are substantially parallel to the second edge 22.

Each wing member 16, 18 comprises a distal tip portion 40, 42 and an extension portion 44, 46 disposed intermediate the distal tip portion 40, 42 and the body 14. The tip portions 40, 42 of the first and second wing member 16, 18 define first and second slots 48, 50, respectively. The first slot 48 extends from the tip segment 26 of the first edge 20 to a first slot end 52 and the second slot 50 extends from the tip segment 28 of the second edge 22 to a second slot end 54, wherein a first engagement segment 56 is disposed between the first slot end 52 and the tip segment 26 of the second edge 22 and a second engagement segment 58 is disposed between the second slot end 54 and the tip segment 28 of the first edge 20. In a preferred embodiment, the first and second slots 48, 50 each define an axis 60, 62 wherein the axis 60 of the first slot 48 is substantially orthogonal to the axis 62 of the second slot 50.

Figure 1B:
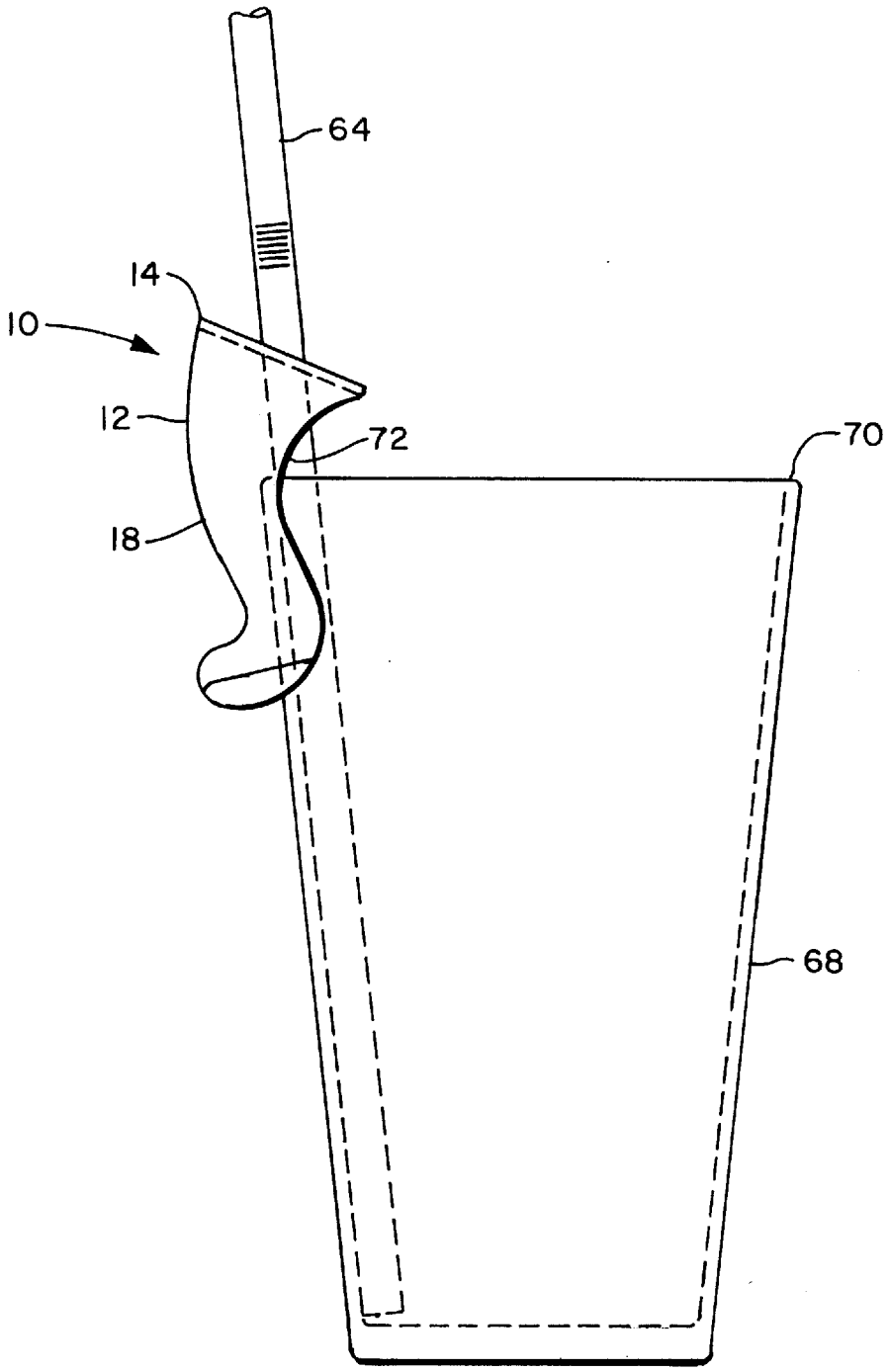
FIG. 1*b* is a side elevation view, partly in phantom, of a straw mounted to a beverage container by the straw holder of FIG. 1*a;*
Figure 3:
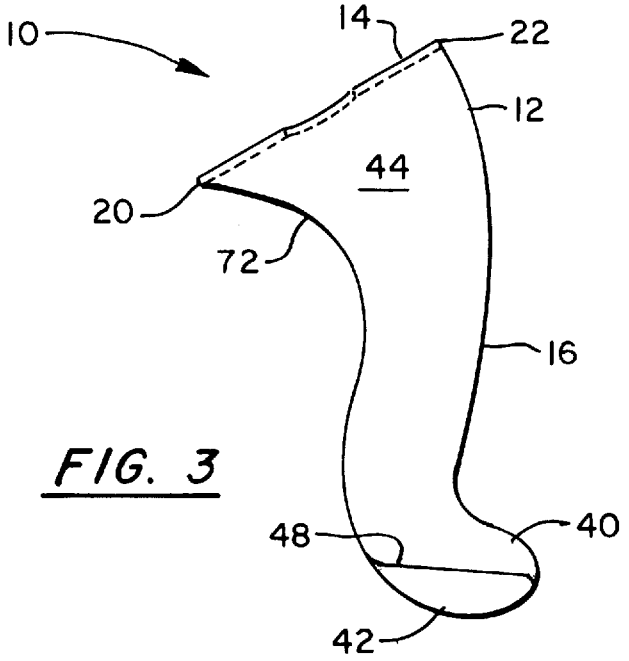
FIG. 3 is an enlarged side view of the second straw holder of FIG. 1, showing the opposite side thereof.
Figure 4:
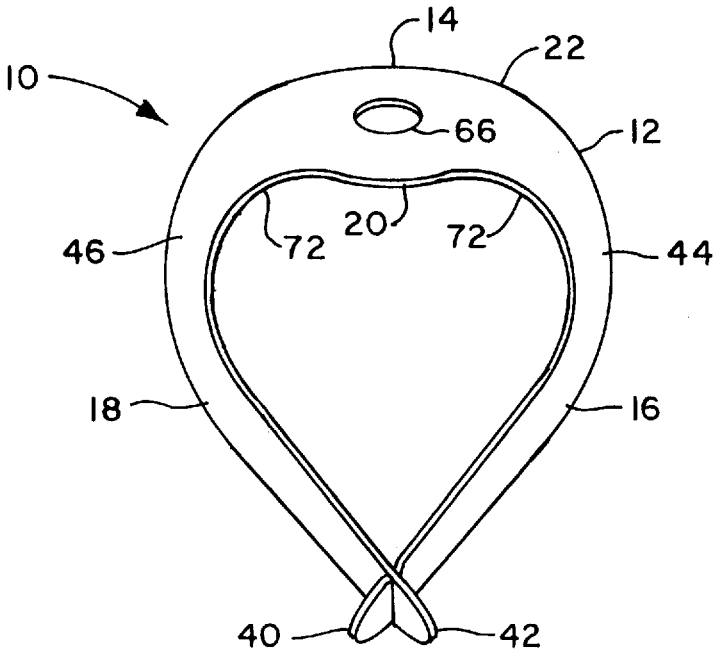
FIG. 4 is an enlarged front view of the first straw holder of FIG. 1.

As shown in FIGS. 1, 3 and 4, the strip 12 is deformable into a three dimensional straw holder 10 by flexing the first and second wing members 16, 18 towards each other and inserting the second engagement segment 58 into the first slot 48 and the first engagement segment 56 into the second slot 50 wherein the first slot end 52 abuts the second slot end 54. The first and second slots 48, 50 engage the second and first engagement segments 58, 56, respectively, thereby mounting and locking the tip portion 40 of the first wing member 16 to the tip portion 42 of the second wing member 18.

The bottom end of a straw 64 is inserted through an opening 66 in the body 14 such that the bottom end of the straw 64 projects downwardly past the tip portions 40, 42 of the strip 12. As shown in FIG. 1, the straw 64 and straw holder 10 are positioned such that the bottom end of the straw 64 is disposed within the container 68, preferably adjacent the bottom of a container 68, and the wing members 16, 18 of the straw holder 10 are disposed exteriorly of the beverage container 68. The inward curve of the proximal portion 36 of the first and second extension segments 30, 32 define a shoulder 72 which rests on the rim 70 of the container 68.

As described above and as shown in FIG. 2, the body segment 24 and the extension segments 30, 32 of the second edge 22 define a substantially arcuate surface. As shown in FIG. 1, such shape minimizes the extent to which the straw holder 10 projects beyond the rim 70 and exterior surface of the container 68. Consequently, the user is less likely to dislodge the straw 64 and straw holder 10 from the container 68 by accidental contact with the straw holder 10. As further described above and as shown in FIGS. 1–4, the two tip segments 26, 28 of the second edge 22 extend outwardly from the extension segments 30, 32 of the second edge 22 and the tip segments 26, 28 of the first edge 20 are substantially parallel to the two tip segments 26, 28 of the second edge 22. Such structure maximizes the length of the first and second slots 48, 50 and the size of the first and second engagement segments 56, 58, to facilitate proper engagement therebetween.

The strip 12 is semi-flexible, wherein the strip 12 may be easily flexed while resiliently resisting such flexure. The flexibility of the strip 12 allows the strip to be easily formed into the three dimensional straw holder 10, as described above. The resistance to flexure causes the extension portion 44, 46 to bow laterally outward when the strip 12 is formed into a straw holder 10, as shown in FIGS. 1 and 4. The bowed structure ensures that the shoulder 72 formed by the proximal portion 36 of the first extension segment 30 is laterally offset from the shoulder 72 formed by the proximal portion 36 of the second extension segment 32. The laterally offset positions of the shoulders 72 provide greater stability when the straw 64 and straw holder 10 are positioned on the container 68. The bowed structure also ensures that the body 14 resists closure of the opening 66 when the strip 12 is formed into a straw holder 10. Although flexure of the strip 12 tends to move the laterally opposite sides 74, 76 of the opening 66 towards each other, the resistance to flexure resists such movement. Consequently, the straw holder 10 does not crimp the straw 64 where it passes through the opening 66.

The semi-flexible property is determined by the mechanical properties of the polymeric material selected for the strip 12 and the thickness of the strip 12. Once the polymeric material has been selected, the thickness of the material is selected such that the strip 12 is thin enough to be easily flexed and yet thick enough to resiliently resist such flexure. For example, strips 12 composed of styrene and having a thickness of 0.020 inches will have the proper semi-flexible property. It should be appreciated that a straw holder 10 in accordance with the invention may be produced inexpensively and is intended for single-use application. However, a non-porous polymeric material may be selected for the strip so that the straw holder 10 may be easily cleaned for reuse.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A straw holder comprising a unitary strip having first and second wing members, first and second, laterally extending edges, and a body disposed intermediate said first and second wing members, said body defining an opening for receiving a straw, said first and second wing members each comprising a tip portion said tip portion of said first wing member defining a first slot extending from said first edge and a first engagement segment extending from said first slot to said second edge, said tip portion of said second wing member defining a second slot extending from said second edge and a second engagement segment extending from said second slot to said first edge, wherein said second engagement segment is receivable in said first slot and said first engagement segment is receivable in said second slot to mount said tip portion of said first wing member to said tip portion of said second wing member.

2. The straw holder of claim 1 wherein said strip is composed of polymeric material and has a thickness which results in said strip being semi-flexible.

3. The straw holder of claim 2 wherein said strip is composed of styrene and has a thickness of 0.020 inches.

4. The straw holder of claim 1 wherein each of said edges has a body segment, first and second tip segments and first and second extension segments disposed intermediate said first and second tip and said body segment, respectively, wherein said body segment and said first and second extension segments of said second edge define a substantially arcuate shape.

5. The straw holder of claim 4 wherein said first edge has a compound arcuate shape.

6. The straw holder of claim 4 wherein said first and second extension segments of said first edge each comprise a proximal portion adjacent said body segment and a distal portion adjacent said tip segment and said body segment comprises a mid portion, wherein said mid portion of said body segment curves outwardly away from said second edge, said proximal portion of said first and second extension segments curve inwardly toward said second edge, and said distal portion of said first and second extension segments are substantially parallel to said second edge.

7. The straw holder of claim 6 wherein said proximal portion of said first and second extension segments define a shoulder for receiving a lip of a beverage container when said tip portion of said first wing member is mounted to said tip portion of said second wing member.

8. A straw holder for mounting a straw to a beverage container having interior and exterior surfaces and a lip, said straw holder comprising a unitary strip having first and second wings, first and second, laterally extending edges, and a body disposed intermediate the first and second wings and defining an opening, said first and second wings being engageable with the exterior surface of the container, said first edge comprising a shoulder for receiving the lip of the beverage container, and said opening for mounting the straw for extension along the interior surface of the container, said first and second wings each comprising a tip portion, said tip portion of said first wing defining a first slot extending from said first edge to a first slot end and a first engagement segment extending from said first slot end to said second edge, said tip portion of said second wing defining a second slot extending from said second edge to a second slot end and a second engagement segment extending from said second slot end to said first edge, wherein said second engagement segment is receivable in said first slot and said first engagement segment is receivable in said second slot to mount said tip portion of said first wing member to said tip portion of said second wing member.

9. The straw holder of claim 8 wherein said strip is composed of polymeric material and has a thickness which results in said strip being semi-flexible.

10. The straw holder of claim 8 wherein said first and second slots each define an axis, wherein said axis of said first slot is substantially orthogonal to said axis of said second slot.

11. The straw holder of claim 8 wherein said tip portion of said first wing is mountable to said tip portion of said second wing, whereby said strip defines a three dimensional straw holder.

12. The straw holder of claim 8 wherein said first edge comprises a body segment, first and second tip segments and first and second extension segments disposed intermediate said first and second tip segments and said body segment, respectively, wherein said first and second extension segments of said first edge each comprise a proximal portion adjacent said body segment and a distal portion adjacent said tip segment and said body segment comprises a mid portion, wherein said mid portion of said body segment curves outwardly away from said second edge, said proximal portion of said first and second extension segments curve inwardly toward said second edge, and said distal portion of said first and second extension segments are substantially parallel to said second edge, whereby said first and second extension segments define said shoulder.

* * * * *

UNITED STATES PATENT AND TRADEMARK OFFICE

CERTIFICATE OF CORRECTION

PATENT NO. : 5,823,493

DATED : 10/20/98

INVENTOR(S) : Eastland, Jr. et al

It is certified that error appears in the above-identified patent and that said Letters Patent is hereby corrected as shown below:

In claim 4, column 5, line 37, after "tip" insert --segment--
and
after "body" delete "segment" and replace with --segments--.

Signed and Sealed this

Thirtieth Day of November, 1999

*Attest:*

*Attesting Officer*

Q. TODD DICKINSON

*Acting Commissioner of Patents and Trademarks*